US006932563B2

(12) United States Patent
Cabrales et al.

(10) Patent No.: US 6,932,563 B2
(45) Date of Patent: Aug. 23, 2005

(54) APPARATUS, SYSTEM AND METHOD FOR MINIMIZING RESONANT FORCES IN A COMPRESSOR

(75) Inventors: Jose Cabrales, Mission Viejo, CA (US); Gerald Duane LaRue, Torrance, CA (US); Ronren Gu, Cypress, CA (US); Angus Lemon, Anaheim, CA (US); John M. Wilson, Redondo Beach, CA (US)

(73) Assignee: Honeywell International, Inc., Morristown, NJ (US)

( * ) Notice: Subject to any disclaimer, the term of this patent is extended or adjusted under 35 U.S.C. 154(b) by 88 days.

(21) Appl. No.: 10/430,467

(22) Filed: May 5, 2003

(65) Prior Publication Data

US 2004/0223843 A1 Nov. 11, 2004

(51) Int. Cl.[7] ..... F01D 25/24

(52) U.S. Cl. ..... 415/58.4; 415/206; 415/226; 415/914

(58) Field of Search ..... 415/58.4, 205, 415/206, 211.2, 221, 226, 914

(56) References Cited

U.S. PATENT DOCUMENTS

| | | | | | |
|---|---|---|---|---|---|
| 4,375,938 | A | * | 3/1983 | Dussourd | 415/58.5 |
| 4,708,584 | A | * | 11/1987 | Meng | 415/58.5 |
| 4,743,161 | A | | 5/1988 | Fisher et al. | |
| 4,930,978 | A | | 6/1990 | Khanna et al. | |
| 4,990,053 | A | | 2/1991 | Rohne | |
| 5,246,335 | A | | 9/1993 | Mitsubori et al. | |
| 6,447,241 | B2 | * | 9/2002 | Nakao | 415/1 |

* cited by examiner

*Primary Examiner*—Ninh H. Nguyen
(74) *Attorney, Agent, or Firm*—Chris James; Ephraim Starr

(57) ABSTRACT

A buffer chamber and outlet guide provide an air path from an intake passage in a compressor housing to an upstream position relative to an intake port of the compressor. Surging is minimized during low airflow conditions while cyclic forces on the blades of the impeller are minimized during high airflow conditions. By providing an air path through the buffer chamber and outlet guide, ribs or other supporting structures are eliminated within the air pathway through the intake port and intake passage within the compressor housing.

24 Claims, 3 Drawing Sheets

APPARATUS, SYSTEM AND METHOD FOR MINIMIZING RESONANT FORCES IN A COMPRESSOR

BACKGROUND OF THE INVENTION

The invention relates in general to compressors and more specifically to an apparatus, system and method for minimizing resonant forces on an impeller of a compressor having a ported shroud.

Rotary compressors are used in a variety of applications for compressing gases. In turbochargers, for example, a rotating impeller within a housing sucks air through an intake port, compresses it in an intake passage and diffuses it in a volute housing. The compressed air is supplied to the intake manifold of an internal combustion engine. The operating range of a compressor extends from a surge condition, occurring at low airflow rates, to a choke condition experienced at high airflow rates. "Surging" occurs when a compressor operates at relatively low flow rates and the flow of air throughout the compressor begins to pulsate. As the airflow rate approaches relatively high volumes, such as when the velocity of the flow approaches the speed of sound, the compressor performance is reduced and choking occurs.

In order to improve the operating flow range, some compressors include drilled ports or openings on the inner wall of the intake passage, also referred to as a shroud, surrounding the impeller. These bypass ports reduce surging by reintroducing the air into the intake port through the bypass ports during low airflow rates.

Conventional compressors utilizing bypass ports or ported shrouds are limited, however, in that the impeller is exposed to cyclic stresses during high-airflow operation. At certain rotational speeds, air flowing through the diversion ports produces resonant forces on the blades of the impeller. The resonant forces may lead to immediate damage of the compressor or at least contribute to wear on compressor components that leads to eventual failure. Some attempts to reduce the resonant forces include asymmetrically spacing the openings forming the bypass ports. The impellers within these designs, unfortunately, still experience the resonant, cyclic forces.

Accordingly, there is a need for an apparatus, system, and method for minimizing resonant forces in compressors at high airflow rates.

BRIEF SUMMARY OF THE INVENTION

In the exemplary embodiment of the invention, resonant forces on an impeller of a ported shroud compressor are minimized by providing an air pathway through an unobstructed intake port. A diversion port directs a portion of the intake air from the intake passage to a buffer chamber during low airflow conditions. Excess air in the buffer chamber is directed outside the intake port through an outlet. During high airflow conditions, intake air flows more uniformly than conventional ported shroud compressors having airflow obstructions and the resonant forces on the impeller are therefore minimized.

DETAILED DESCRIPTION

In an exemplary embodiment of the invention, an apparatus, system and method minimizes cyclic, resonant forces in a compressor at high flow rates by providing an unobstructed intake port and a diversion port to a buffer chamber. As explained above, conventional compressors including a ported shroud are limited in that cyclic forces are produced at high airflow rates. Conventional designs require at least some housing material, such as "ribs", or other supports to hold a portion of the housing that separates the intake port from the bypass port. In conventional designs, air passing through the bypass ports during high volume airflow is obstructed by housing material or ribs. These air barriers cause the air to deviate form a uniform flow resulting in unbalanced forces on the blades of the impeller. At certain rotational speeds, the forces stress the impeller in accordance with a harmonic forcing function.

In the exemplary embodiment, a tapered, unobstructed intake port, avoids the use of ribs or other support structures. A continuous annular groove within an inner wall or shroud of the housing forms a diversion port. The groove is formed within the intake passage surrounding the impeller and connects the intake passage to a buffer chamber. An outlet provides a connection between the chamber and an upstream position along an air pathway connected to the intake port.

Figure 1:
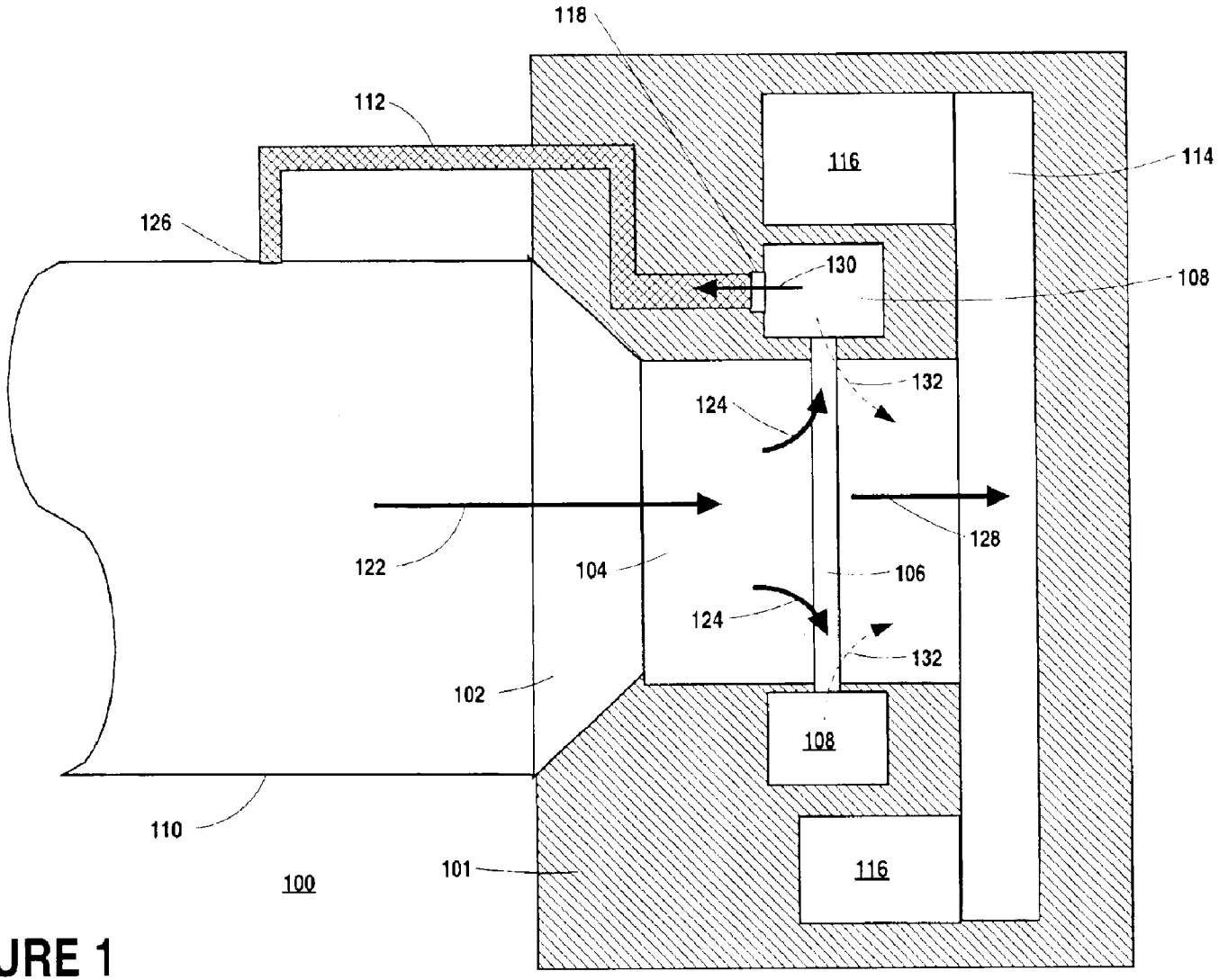
FIG. 1 is a block diagram of a side view of a compressor in accordance with an exemplary embodiment of the invention.

FIG. 1 is a block diagram of a side view of a compressor 100 in accordance with an exemplary embodiment of the invention. FIG. 1 includes various blocks that represent components, regions, and areas within the compressor 100 in an illustrated arrangement that parallels a schematic representation of a side sectional view of the compressor in accordance with the exemplary embodiment. The blocks illustrated in FIG. 1 do not necessarily represent the relative sizes or positions of the compressor components or regions of the compressor 100. The compressor 100 of the exemplary embodiment is suitable for use as part of an exhaust turbocharger used with internal combustion engines.

Any one of various techniques can be used to manufacture the compressor housing 101 and compressor components. As explained below in further detail, the exemplary compressor housing 101 is formed using casting and machining techniques. The compressor housing 101 includes an intake port 102 where intake air 122 is received from a duct 110 and directed through an intake passage 104 to a diffuser region 114 by a rotating impeller (not shown) positioned within the intake passage 104. A diversion port 106 connects the intake passage 104 to a buffer chamber 108. The intake passage 104 includes a front portion and a rear portion where the front portion corresponds to a region near the impeller that is often referred to as an "inducer". The rear portion of the intake passage 104 corresponds to the region near the portion of the impeller often referred to as an "exducer". In the exemplary embodiment, the transition from the front portion to the rear portion occurs between the diversion port 106 and the diffuser 114. In the exemplary embodiment, the diversion port 106 is formed by machining an annular groove (106) along the inner wall of the intake passage 104. The diversion port 106, however, may be formed in other ways. The diversion port 106, for example, may comprise a series of inclined or radial holes or slots connecting the intake passage 104 to the buffer chamber 108. Although the buffer chamber 108 may have any of one of several shapes, the chamber 108 is an annular region surrounding the intake passage 104 in the exemplary embodiment. The buffer chamber 108, therefore, is a doughnut-shaped region following the contour of the compressor housing 100 in the exemplary embodiment. Accordingly, the buffer chamber 108 is shown as two boxes (108) in FIG. 1 in order to provide an illustration that parallels a schematic representation of a side sectional view of the compressor 100. In some circumstances, the buffer chamber 108 may only partially surround the intake passage 104 or may be positioned in other areas within the compressor housing 101.

The buffer chamber 108 includes at least one outlet 118 directed outside of the intake port 102. The outlet 118 is connected to the duct 110 at an upstream position 126 through an outlet guide 112. The outlet guide 112 is any type of hose, tube, pipe or duct that provides a outlet air path from the outlet 118 to the upstream position 126 that is located upstream along the air pathway to the intake port 102. The outlet guide 112 is a rubber hose in the exemplary embodiment. The duct 110 is any type of duct, hose, flexible tube, solid tube, pipe or other mechanism that provides an air pathway for incoming air to travel to the intake port. An example of a suitable duct 110 is a semi-flexible rubber hose connecting an air filter assembly to the intake port 102.

During operation, a rotating impeller (not shown) within the intake passage 104 sucks intake air 122 into the compressor from the duct 110 through the intake port 102. During low airflow operation, main-flow air 128 is directed through the rear portion of the intake passage 104 to the diffuser 114 while diverted air 124 is directed though the diversion port 106 into the buffer chamber 108. The main-flow air 128 continues through the diffuser 114 to a volute 116 where it is diffused in accordance with known techniques. Surging is reduced by allowing the diverted air 124 to "bleed off" into the buffer chamber 108 during the low airflow operation. Air pressure within the buffer chamber 108 is maintained at a level that allows the diverted air 124 to enter the buffer chamber 108 by directing excess air 130 from the buffer chamber 108 through an outlet 118 to an area outside the intake port 102. The outlet guide 112 provides an air path from the outlet 118 to the upstream position 126 of the air pathway defined by the inner wall of the duct 110.

During high airflow operation, all of the intake air 122 is directed through the diffuser region 114 to the volute 116. In addition, chamber air 132 is directed from the buffer chamber 108, through the diversion port 106 and into the diffuser region 114. In the exemplary embodiment, the diversion port is positioned within the last part of the front region of the intake passage 104. The chamber air 132, therefore, flows through the last part of the front region and through the rear portion of the intake passage 104 before it enters the diffuser region 114. The chamber air 132 is shown as a dashed line arrow to illustrate that the chamber air 132 does not flow during the low airflow conditions. In the exemplary embodiment, the diversion port 106 is an annular groove within the intake passage 104 and the intake port is a tapered, unobstructed opening which results in a uniform, or nearly uniform, flow of air through the intake passage 104 during high speeds. In contrast to conventional designs, resonant forces caused by air flow passing the blades of the impeller are significantly reduced. Accordingly, the compressor 100 has a wider operating range and is more reliable than conventional compressors.

Figure 2:
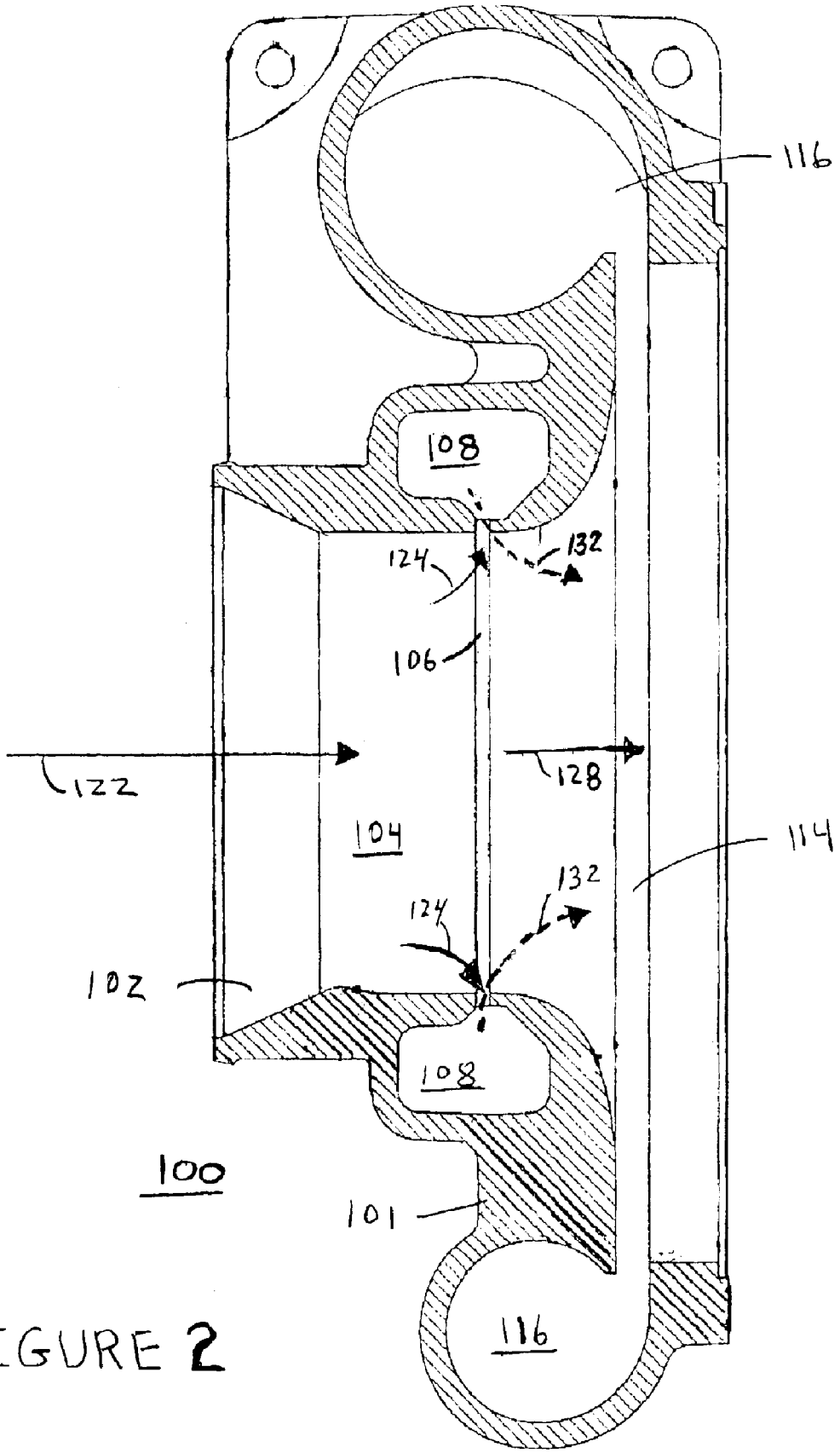
FIG. 2 is a schematic representation of a sectional side view of the compressor in accordance with the exemplary embodiment of the invention.
Figure 3:
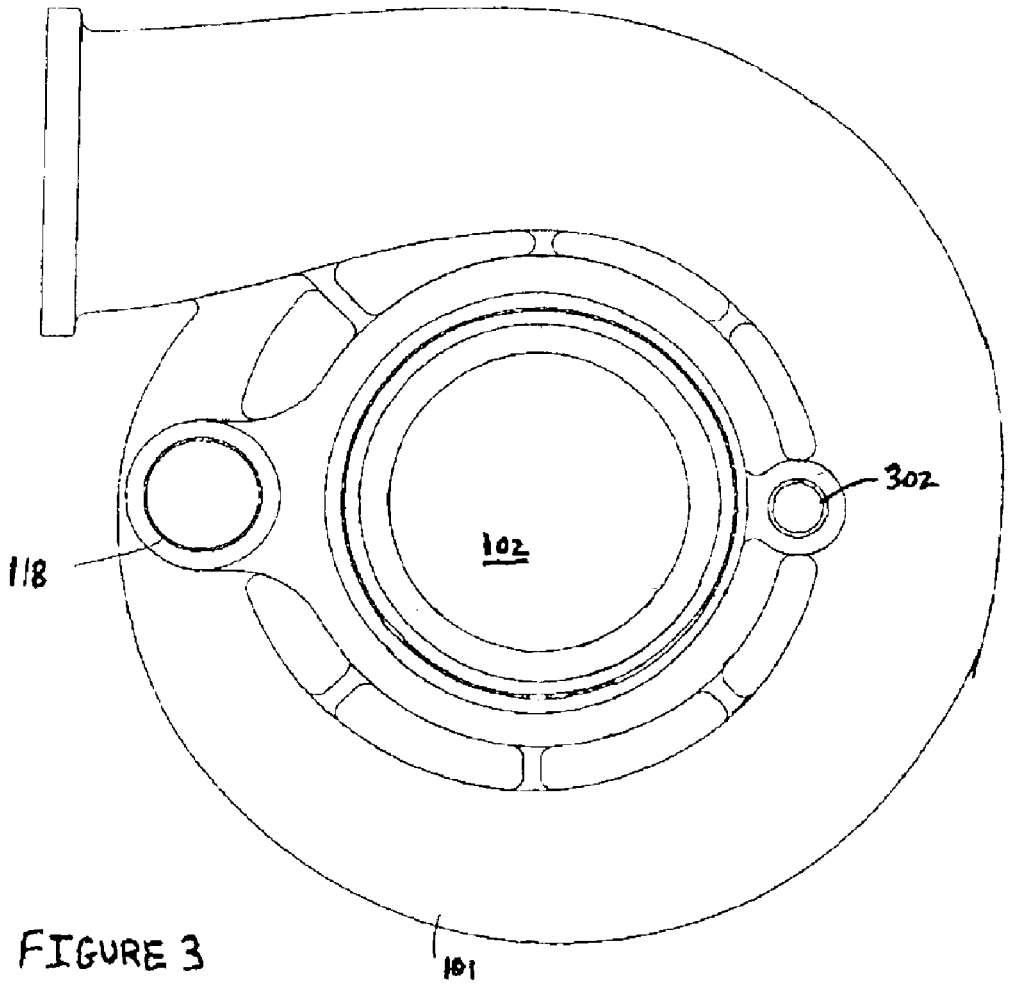
FIG. 3 is a schematic representation of a top view of the compressor in accordance with the exemplary embodiment of the invention.

FIG. 2 is a schematic representation of a sectional side view and FIG. 3 is a top view schematic representation of the compressor 100 in accordance with the exemplary embodiment of the invention. In accordance with the teachings herein, known techniques are used to form the various components of the compressor 100. The housing 101 is formed in a casting and machined to form the appropriate interfaces and components. In order to form the buffer chamber 108, a sand core is fitted within the casting and supported through at least one pedestal positioned where the outlet 118 is formed. In the exemplary embodiment, a second pedestal is used to support the sand core which results in a second opening 302 to the buffer chamber 108. The sand core is broken apart and removed through the outlet 118 and/or the second opening 302 after the housing 101 has hardened and cooled. The second opening 302 is sealed with a plug after the formation of the housing 101.

As will be recognized by those skilled in the art, the intake port 102 and intake passage 104 may be formed by boring, machining, and polishing the housing 101. The diversion port 106 is formed by cutting an annular groove along the inner wall of the intake passage 104 using known machining techniques. Other techniques of forming the diversion port 106 include drilling or machining holes or slots. The size, shape and position of the diversion port 106 depends on the size, style, and desired operating range of the particular compressor 100 and are chosen to provide the appropriate flow of diverted air 124 during low airflow conditions to reduce surging and the desired flow of chamber air 132 during high airflow conditions.

As explained above, the buffer chamber 108 is cast within the housing 101 and is an annular doughnut-shaped region surrounding the intake passage 104 formed using a sand core in the exemplary embodiment. Other than an outlet 118 directed outside the intake port 102, the buffer chamber 108 is an enclosed region connected to the intake passage 104 through the diversion port 106. Therefore, the buffer chamber 108 is connected to intake passage through a first air path including the diversion port 106 and through a second air path including the outlet 118, the outlet guide 112, a portion of the duct 110 from the upstream position 126 to the intake port 102, and the intake port 102. During low airflow conditions, a portion of the intake air 122 is diverted through the first air path through the diversion port 106 into the buffer chamber 108. Excess air 130 is directed along the second air path through the outlet 118, outlet guide 112, the duct 110 and the intake port 102. During high airflow conditions, the air flows into the intake passage 104 as intake air 122 through the duct 110 and intake port 102 as well as along the second air path through the outlet guide 112, outlet 118, buffer chamber 108 and the diversion port 106.

The main air flow path into the compressor 100, therefore, is not obstructed by ribs, housing materials, protrusions, or other items that result in resonant forces on the impeller. At low airflow volumes, surging is reduced with the use of the buffer chamber 108 while at high airflow volumes, resonant forces are minimized. The useful operating range, as well as the reliability of the compressor 100, is maximized.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A single piece, cast compressor housing comprising:

an intake passage configured to house an impeller on an axis to direct intake air from an intake port in the compressor housing through the intake passage; and a diversion port connecting the intake passage to a buffer chamber defined within the compressor housing, the buffer chamber having an axial dimension greater than the maximum axial dimension of the diversion port defined by the compressor housing, and an outlet directed outside of the intake passage.

2. A compressor housing in accordance with claim 1, wherein the diversion port is an uninterrupted annular groove formed into a wall of the intake passage.

3. A compressor housing in accordance with claim 2, wherein the outlet is configured to connect to an outlet guide for connecting to an upstream position relative to the intake port.

4. A compressor housing in accordance with claim 3 wherein the buffer chamber is an annular enclosed region surrounding the intake passage and is connected to the intake passage only through a first air path through the diversion port and a second air path through the outlet guide.

5. A compressor housing in accordance with claim 4, wherein the outlet guide is selected from the group that includes a hose, a pipe, a tube, and a duct.

6. A compressor housing in accordance with claim 4, wherein the compressor housing is configured to direct diverted air of the intake air through the diversion port into the buffer chamber during low airflow conditions.

7. A compressor housing in accordance with claim 6, further comprising a volute connected to the intake passage through a diffuser region, wherein the compressor housing is configured to direct the intake air through the intake passage through the diffuser region into the volute during high airflow conditions.

8. A compressor housing in accordance with claim 7, wherein the compressor housing is further configured to direct chamber air from the buffer chamber into the intake passage during high airflow conditions.

9. A compressor housing in accordance with claim 1, wherein the diversion port comprises a plurality of holes formed into a wall of the intake passage.

10. A single piece, cast compressor housing for a turbocharger, the compressor housing comprising:

an intake passage configured to house an impeller on an axis to direct intake air from an intake port in the compressor housing through the intake passage;

an annular buffer chamber defined within the compressor housing and at least partially surrounding the intake passage; and an annular groove within a wall of the intake passage forming a diversion port connecting the intake passage to the annular buffer chamber, the annular buffer chamber having an axial dimension greater than the maximum axial dimension of the diversion port defined by the compressor housing, and an outlet directed outside of the intake passage.

11. A compressor housing in accordance with claim 10, wherein the annular buffer chamber is connected to the intake passage only by a first air path through the diversion port and by a second air path to an upstream position relative to the intake port.

12. A compressor housing in accordance with claim 11, wherein the second air path is through the outlet, the outlet guide, and a duct connected to the intake port.

13. A compressor housing in accordance with claim 11, wherein the outlet guide is selected from the group that includes a hose, a pipe, a tube, and a duct.

14. A compressor housing in accordance with claim 11, wherein the compressor housing is configured to direct diverted air of the intake air through the diversion port into the buffer chamber during low airflow conditions.

15. A compressor housing in accordance with claim 14, further comprising a volute connected to the intake passage through a diffuser, wherein the compressor housing is configured to direct the intake air from the intake passage through the diffuser region into the volute during high airflow conditions.

16. A compressor housing in accordance with claim 15, wherein the compressor housing is further configured to direct diverted chamber air from the buffer chamber into the intake passage during high airflow conditions.

17. A compressor assembly for a turbocharger, the compressor assembly comprising:

a single piece, cast compressor housing having an axis, an intake port, an intake passage, a buffer chamber defined within the compressor housing and a diversion port connecting the intake passage to the buffer chamber wherein the buffer chamber has an axial dimension greater than the maximum axial dimension of the diversion port;

a duct connected to the intake port; and an outlet guide connected between the buffer chamber and the duct at an upstream position relative to the intake port.

18. A compressor assembly in accordance with claim 17, wherein the diversion port is an annular groove formed into a wall of the intake passage.

19. A compressor assembly in accordance with claim 18, wherein the outlet is configured to connect to an outlet guide for connecting to an upstream position relative to the intake port.

20. A compressor assembly in accordance with claim 19, wherein the buffer chamber is an annular enclosed region surrounding the intake passage and is connected to the intake passage only by a first air path through the diversion port and by a second air path through the outlet guide.

21. A compressor assembly in accordance with claim 17, wherein the outlet guide is selected from the group that includes a hose, a pipe, a tube, and a duct.

22. A compressor assembly in accordance with claim 17, wherein the compressor housing is configured to direct diverted air of the intake air through the diversion port into the buffer chamber during low airflow conditions.

23. A compressor assembly in accordance with claim 22, further comprising a volute connected to the intake passage through a diffuser, wherein the compressor housing is configured to direct the intake air through the intake passage through the diffuser into the volute during high airflow conditions.

24. A compressor assembly in accordance with claim 23, wherein the compressor housing is further configured to direct diverted chamber air from the buffer chamber into the intake passage during high airflow conditions.

* * * * *